US006477777B1

(12) United States Patent
Oliveri

(10) Patent No.: US 6,477,777 B1
(45) Date of Patent: Nov. 12, 2002

(54) GRAVITY KNIFE AND BACKBONE

(76) Inventor: Joseph A. Oliveri, 1866 W. Hoppe Rd., Unionville, MI (US) 48767

( * ) Notice: Subject to any disclaimer, the term of this patent is extended or adjusted under 35 U.S.C. 154(b) by 0 days.

(21) Appl. No.: 09/892,876

(22) Filed: Jun. 28, 2001

Related U.S. Application Data

(60) Provisional application No. 60/214,915, filed on Jun. 29, 2000.

(51) Int. Cl.[7] ..... B26B 1/04

(52) U.S. Cl. ..... 30/161; 30/160

(58) Field of Search ..... 30/160, 161, 158

(56) References Cited

U.S. PATENT DOCUMENTS

| | | | | |
|---|---|---|---|---|
| 998,046 A | | 7/1911 | Stewart | |
| 1,105,080 A | | 7/1914 | Jacques | |
| 4,612,706 A | * | 9/1986 | Yunes | 30/160 |
| 5,136,592 A | | 8/1992 | Newton et al. | |
| 5,495,673 A | | 3/1996 | Gardiner et al. | |

* cited by examiner

*Primary Examiner*—Douglas D. Watts
(74) *Attorney, Agent, or Firm*—Patent & Trademark Services; Thomas Zack; Joseph H. McGlynn

(57) ABSTRACT

A foldable pocket knife with an attached backbone. The backbone is pivotally attached to the handle of the knife. A finger hole is located in the rear of the backbone and used to pull the knife from a user's pocket and flip the blade to an exposed opened position.

5 Claims, 2 Drawing Sheets

GRAVITY KNIFE AND BACKBONE

Applicant claims the priority of Provisional application No. 60/214,915, filed Jun. 29, 2000.

BACKGROUND OF THE INVENTION

This invention relates to a foldable pocket knife that has backbone to make removing the knife easier.

Many types of pocket knives are known. In one earlier patent a corn knife has a finger hole attached to the handle.

Another prior art folding knife has a finger hole attached to one end.

Still another knife has a rotating sheath that pivots into the down portion to make withdrawing the knife easier. One additional knife has a removable support clip attached at one end.

DESCRIPTION OF THE PRIOR ART

Knives that fold or have modifications to permit their easy removal, or both, are known. For example, U.S. Pat. No. 998,046 to Stewart discloses a corn knife with a finger hole attached to its handle.

U.S. Pat. No. 1,105,080 to Jacques discloses a folding knife with a finger hole attached to one end.

U.S. Pat. No. 5,163,592 to Newton et al discloses a knife with a rotating sheath that pivots into the down portion to make withdrawing the knife easier.

U.S. Pat. No. 5,495,673 to Gardiner et al discloses a knife that has a removable support clip attached at one end.

In the present invention a foldable knife has a finger hole positioned to permit its easy and rapid blade withdrawal, all as will be detailed in the specification that follows hereafter.

SUMMARY OF THE INVENTION

This invention relates to knife having a backbone with a finger hole for easy removal of the knife from a pocket or sheath.

It is the primary object of the present invention to provide for knife with an attached backbone that has a finger hole.

Another object is to provide for such a knife in which the backbone is pivotally attached to the handle of the knife, with the backbone extending most of the length of the handle, and with the finger hole located at the end opposite where the knife handle is attached to the blade.

It is an object of the present invention to provide for knife which can be easily removed from a pocket or sheath.

These and other objects and advantages of the present invention will become apparent to readers from a consideration of the ensuing description and the accompanying drawings.

DESCRIPTION OF THE PREFERRED EMBODIMENT

Figure 1:
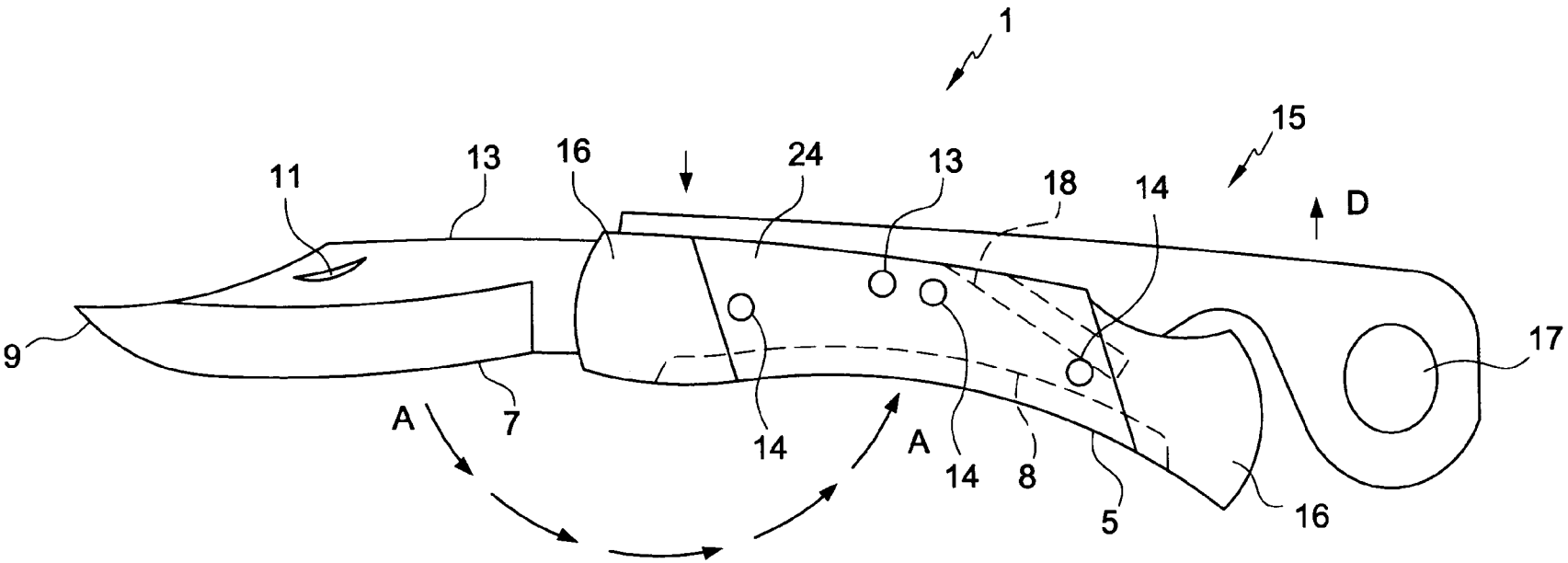
FIG. 1 is a side front view of the present invention.

FIG. 1 is a side front view of the present invention. The knife 1 of the present invention has a blade portion 3 pivotally mounted to a handle portion 5. Extending along the length of the blade is a cutting edge 7. Edge 7 extends from a sharp point 9 at one end and goes to the blade rear portion just in front of an internal pivot pin (not shown), used to pivotally mount the blade to the knife handle portion 5. A small indentation 11 in the blade surface can be used to pull on the blade with a user's fingernail to open or expose the blade when it is seated partially within the handle portion 5. The arrows AA show the direction the blade pivots to become seated in the handle 5 when in a folded or closed position. When so pivoted, the blade edge 7 is concealed within the handle slot 8 extending lengthwise of the handle 5 (see dotted lines) to protect both the knife edge 7 and the user.

Pivotally mounted to the handle portion 5, above slot 8, by a pivot pin 13 is the knife backbone 15. The backbone consists of a single metallic strip extending most of the length of the handle and which extends past the handle at the rear (see also FIGS. 2 and 3. A finger hole 17, formed in the backbone 15, is used to pull the closed knife 1 out of a user's pocket, and to flip the closed knife to an opened position such as that shown in FIG. 1. Mounted within the handle 5, and engaging the backbone 15, is an angular pressure pin 18, shown in dotted line format (see also FIG. 2).

Pin 18 is an elongated generally straight spring which bears against the underside of the backbone 15 to bias the backbone 15 upwardly, as the knife is shown in FIG. 1. The pin 18 is removable from the interior of the handle and acts as a spring to exert a force on the backbone to move it out of its seated engagement with the knife handle 5 as the front of the backbone pivots relative to the handle on pivot pin 13. As the backbone attempts to move upward, its forward end, the end opposite the finger hole 17, is positioned to engage the back portion of the blade 3 to lock it in an opened position. Using some wrist action and practice, a user may easily remove the knife from a pocket or sheath (not shown) and flip it to the blade opened position.

Also shown in FIG. 1 are three spaced rivets 14 used to hold a decorative material 24 to the sides of the handle 5. Brass or other metallic front and rear end pieces 16 may also cover the outer surface of the handle for a decorative and protective surface.

Figure 2:
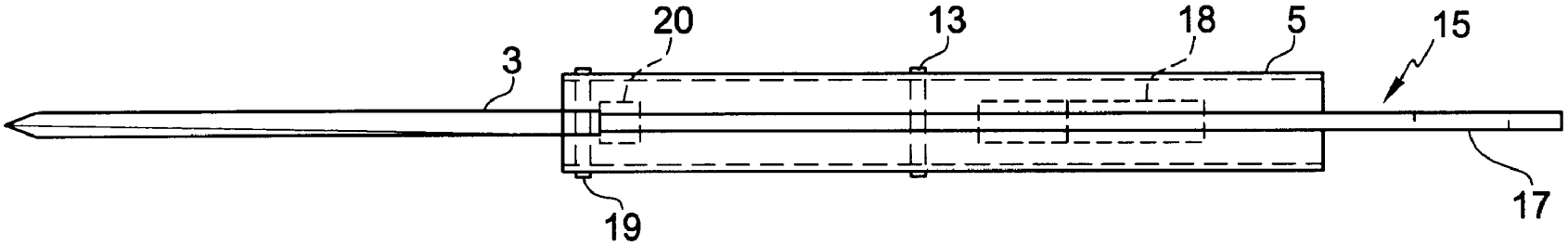
FIG. 2 is a top view of the present invention showing the backbone extending most of the length of the knife handle.

FIG. 2 is a top view of the present invention showing the backbone 15 extending beyond the end of the knife handle 5. Near the end of blade 3, nearest the handle, a pivot pin 19 (shown in dotted line format) attaches the blade to the handle. Pin 19 goes through the thickness of the blade and is mounted at both of its two ends into the body of the handle portion 5. A small end or rear portion 20 (shown in dotted lines in FIG. 2) of the blade 3 extends past the pivot pin 19 and under the front end of the backbone 15. The pivot pin 13, used to pivotally mount the backbone 15 to the handle 5, is also shown in dotted line format to the rear of the pin 19. Spring 18, shown in dotted line format, is positioned in the handle below the backbone 15 and to the rear of the pivot pin 13. The backbone 15 is positioned approximately in the middle of the thickness of the handle 5 and has its rear finger hole 17 extending past the rear end of the handle 5.

In this manner when the front end of the knife, i.e. the end with pin 19, is in a closed blade position, and the knife is inserted end first into a user's pocket, the finger hole portion 17 of the backbone 15 will normally extend slightly out of the pocket. This permits a user to use a finger, inserted into backbone hole 17, to pull the knife out of their pocket and flip the closed blade to an opened position such as is shown in FIG. 1. It is the combination of this flipping action combined with the force exerted by spring 18 which opens the blade from its seated position in the handle. When the user flicks the backbone, this will cause the backbone to move slightly away from the handle. At this point, the spring 18 will exert force on the underside of the backbone causing it to pivot about pivot pin 13. As the back end of the backbone 15 moves in the direction of the arrow D in FIG. 1, the front end of the backbone will pivot down, thereby exerting pressure on the back end of the blade 3, which will cause the blade to move to the opened position.

Figure 3:
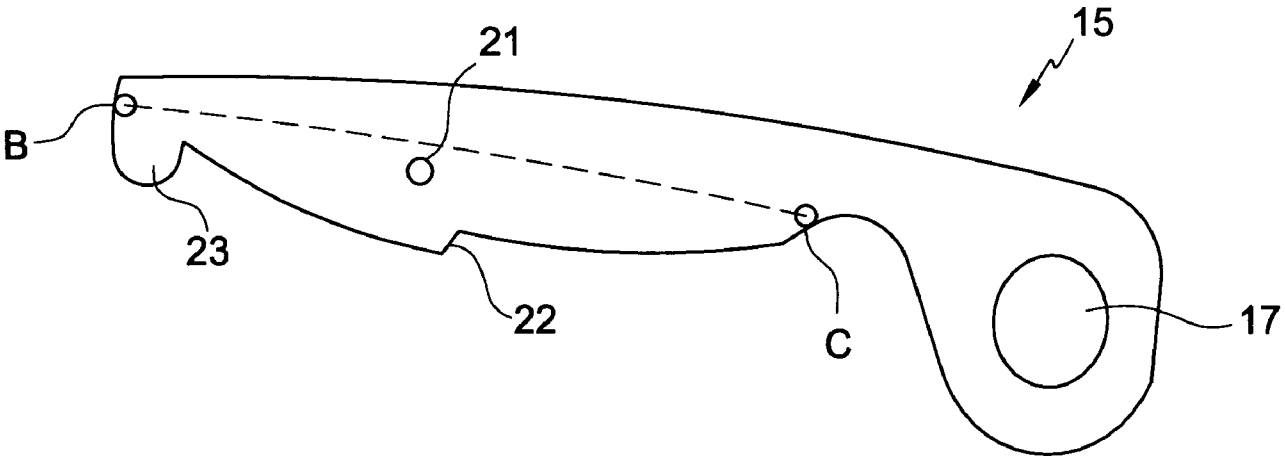
FIG. 3 is a side view of the backbone of the present invention.

FIG. 3 is a side view of backbone 15 used with the knife shown in FIGS. 1 and 2. The metallic material making up the backbone 15, for example, brass or stainless steel, is of one piece or unitary construction. At the rear end of the backbone is the finger hole 17 extending through the backbone. Closer to the other or front end is the hole 21 used to receive the pivot pin 13 and attach the backbone to the knife. A lower notch 22 below the pivot hole 21 and to its rear engages the front end of spring pin 18 at one of its two ends. The other opposite end of spring pin 18 extends to the rear of the handle and bears against an internal slot surface.

Still nearer the front end of the backbone 15 is a hook-like protrusion 23. The protrusion 23 is used to lock the opened blade in an exposed position as it bears down upon the top rear surface of the rigid blade portion 20, located just past pivot pin 19. Combined with the force exerted on the backbone 15 by internal spring 18, the bearing down by protrusion 23 acts to keep the blade locked in position.

Some of the front lower portion of the backbone is seated within the confines of the knife handle 5. Starting at approximately point B and extending in a straight line to point C, the lower front end portion of the backbone 15, below the dotted line shown in FIG. 3, is concealed within the handle 5.

It should be apparent that a certain degree of customizing of the backbone configuration may be necessary to insure it will operate with a specific pocket knife. It is essential that the backbone be of strong material and be pivotally attached to the body of the knife, usually at the handle, and have a finger hole. Some pocket knives may have their own internal blade lock mechanism thereby changing the front end design for the backbone. Still other variations in the outer configuration of the backbone may also be necessary depending on the knife.

What I claim as my invention is:

1. A knife comprising:

a blade and a handle, said blade being pivotably attached to said handle, whereby said blade can be moved from a first position where the blade is folded with respect to said handle into a nonuse position, to a second position where said blade is unfolded with respect to said handle into a in-use position, means for assisting moving said blade from said first position to said second position, said means comprising:

a backbone, said backbone having a first end and a second end, said first end being positioned adjacent said blade, and said second end being positioned remote from said blade, means for pivotally attaching said backbone to said handle, said backbone being moved from a first position where said backbone second end is adjacent said handle to a second position where said second end of said backbone is remote from said handle, said means for pivotally attaching said backbone to said handle being positioned in said handle adjacent said blade, said first end of said backbone engaging said blade when said backbone is moved from said first position to said second position in order to assist in moving said blade from said first position to said second position, and wherein said handle has a recess, and a spring means is positioned in said recess for assisting in moving said blade from said first position to said second position.

2. The knife as claimed in claim 1, wherein said spring means is positioned between said handle and said backbone.

3. The knife as claimed in claim 1, wherein said backbone has means for pulling said knife from a container.

4. The knife as claimed in claim 3, wherein said means for pulling said knife from a container is an aperture.

5. The knife as claimed in claim 4, wherein said aperture is positioned in said second end of said backbone.

* * * * *